US007193567B1

(12) United States Patent
Ryken, Jr. et al.

(10) Patent No.: US 7,193,567 B1
(45) Date of Patent: Mar. 20, 2007

(54) TM MICROSTRIP ANTENNA WITH GPS FREQUENCY COVERAGE

(75) Inventors: Marvin L. Ryken, Jr., Oxnard, CA (US); Albert F. Davis, Ventura, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 25 days.

(21) Appl. No.: 11/264,333

(22) Filed: Oct. 28, 2005

(51) Int. Cl.
*H01Q 1/38* (2006.01)

(52) U.S. Cl. ..... 343/700 MS; 343/846

(58) Field of Classification Search ..... 343/700 MS, 343/829, 846
See application file for complete search history.

(56) References Cited

U.S. PATENT DOCUMENTS

| | | | | |
|---|---|---|---|---|
| 5,068,669 | A * | 11/1991 | Koert et al. | 343/700 MS |
| 5,410,322 | A * | 4/1995 | Sonoda | 343/700 MS |
| 6,281,844 | B1 * | 8/2001 | Kodim et al. | 343/700 MS |
| 6,326,923 | B2 * | 12/2001 | Shigihara | 343/700 MS |
| 6,549,168 | B1 * | 4/2003 | Ryken et al. | 343/700 MS |
| 6,630,907 | B1 * | 10/2003 | Ryken et al. | 343/700 MS |

* cited by examiner

*Primary Examiner*—Tho Phan
(74) *Attorney, Agent, or Firm*—David S. Kalmbaugh

(57) ABSTRACT

A Telemetry antenna which uses microstrip antenna technology to cover the 2200 to 2300 MHz TM frequency band and a GPS microstrip antenna to cover the L1 Band at a frequency of approximately 1575 MHz. The antenna 12 fabricated from high dielectric constant material to reduce the size of the antenna which has a diameter of 1.364 inches.

20 Claims, 5 Drawing Sheets

TM MICROSTRIP ANTENNA WITH GPS FREQUENCY COVERAGE

BACKGROUND OF THE INVENTION

1. Field of the Invention

The present invention relates generally to a microstrip antenna for use on a weapons system. More specifically, the present invention relates to a TM microstrip antenna with frequency coverage over a frequency range of 2200 to 2300 MHz which is the TM frequency band as well as coverage over the L1 GPS frequency band.

2. Description of the Prior Art

The Hardened Subminiature Telemetry and Sensor System (HSTSS) program is a Department of Defense for identifying, developing and validating inexpensive, rugged, microelectronic technologies for incorporation into instrumentation and telemetry systems. The instrumentation and telemetry systems incorporating HSTSS technology are designed for use in the harsh environments of small missile and gun launched munitions applications. HSTSS qualification of new technologies and state of the art components will result in inexpensive and reliable components for the successful development, fielding and maintenance of modern weapons systems.

There is a need for a small diameter, lightweight TM microstrip antenna with GPS frequency coverage which meets the requirements of HSTSS program. The major problems associated with using current technology are the limitation on size requirements for an antenna with GPS and TM operational capability, and the requirement for a 40 dB minimum isolation between the GPS and TM antenna elements.

SUMMARY OF THE INVENTION

The present invention overcomes some of the disadvantages of the prior art in that it comprises a highly effective TM microstrip antenna with frequency coverage over a frequency range of 2200 to 2300 MHz which is the TM frequency band as well as coverage over the L1 GPS frequency band.

The TM antenna radiating element is a copper radiating element mounted on the top layer of a circuit board for the antenna. A ceramic GPS square shaped microstrip antenna is positioned above the TM antenna radiating element on the circuit board. A filter top printed circuit board is also included within the TM microstrip antenna. The filter top printed circuit board has a first filter which is a band stop filter at the TM frequency of approximately 2.25 GHz, and a second filter which is a band stop filter at the GPS frequency of approximately 1575 MHz.

The Antenna is fabricated from high dielectric constant material (10.2) to reduce the size of the antenna which has a diameter of 1.364 inches. Forty dB isolation is achieved in the TM and GPS frequency bands by the band stop filters on the filter top printed circuit board.

DETAILED DESCRIPTION OF THE PREFERRED EMBODIMENT

Figure 1:
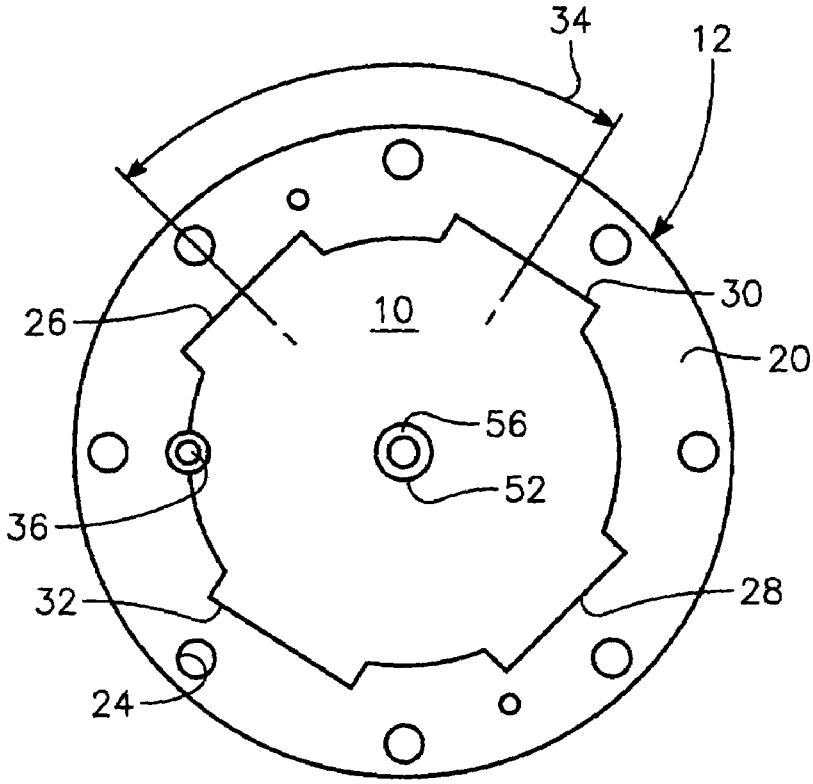
FIG. 1 illustrates the top layer of the circuit board for the TM microstrip antenna with GPS frequency coverage comprising the present invention.
Figure 2:
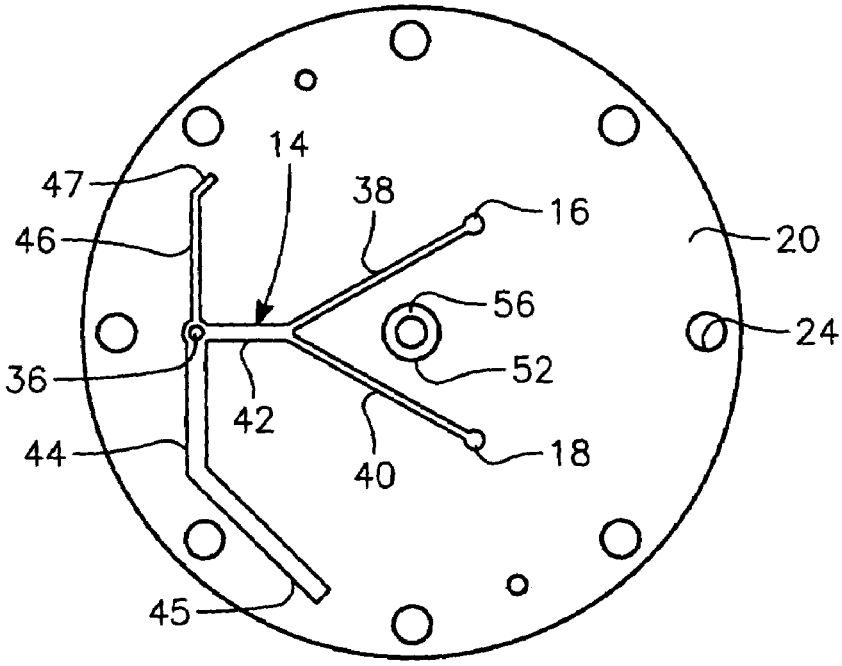
FIG. 2 illustrates a top view of the bottom layer of the circuit board of FIG. 1 for the TM microstrip antenna.

Referring to FIGS. 1 and 2, there is shown a Telemetry antenna 12 which uses microstrip antenna technology to cover the 2200 to 2300 MHz TM frequency band. Antenna 12 is fabricated from high dielectric constant material (10.2) to reduce the size of the antenna which has a diameter of 1.364 inches.

As shown in FIG. 2, antenna 12 includes a filter 14 which is electrically connected to radiating element 10 by a pair of copper vias or plated through connecting pins 16 and 18. The copper plated connecting pins 16 and 18 are the feeds for radiating element 10 (FIG. 1). The radiating element 10 of antenna 12 is mounted on the upper surface of a dielectric substrate/printed circuit board 20 which is the circuit board, while the filter 14 of antenna 12 is mounted on the bottom surface of dielectric substrate 20.

The dielectric substrate 20 has the shape of a circle with a diameter of about 1⅜ inches. Positioned around the circumference of dielectric substrate 20 are eight equally spaced apart 0.089-inch diameter mounting holes 24 which are adapted for mounting the antenna 12 to a projectile.

The radiating element 10 for antenna 12 is also circular in shape and is adapted to transmit an RF (radio frequency) signal within the S-band frequency range of 2.2–2.3 GHz. The diameter of radiating element is approximately ⅞ of an inch. Radiating element 10 includes a first pair of tuning tabs 26 and 28 which are positioned 180° from one another about the circumference of radiating element 10. Radiating element 10 also includes a second pair of tuning tabs 30 and 32 which are positioned 180° from one another about the circumference of radiating element 10. The angle between adjacent tuning tabs 28 and 30 is approximately 80° as is best indicated by arrow 34.

The upper surface of dielectric substrate 20 also has an isolated feed 36. The feed 36, which is a 50 ohm input and is electrically connected to filter 14, passes through dielectric substrate 20 to the filter 14.

Referring now to FIG. 2, filter 14 includes a pair of 100 ohm transmission lines 38 and 40 which are connected to one end of a 50 ohm transmission line 42. The opposite end of 50 ohm transmission line 42 is connected to feed input 36. Transmission lines 38 and 40 extend from transmission line 42 at angles of about 35°. Filter 14 also has a pair of filter stubs 44 and 46 which extend from feed input 26 and are perpendicular to transmission line 42. Stubs 44 and 46 have their respective ends 45 and 47 angled downward ar approximately 45°. Filter 14 is designed to isolate a transmitted telemetry signal in the 2.2–2.3 GHz range from a GPS signal which generally operate in the L1 Band at a frequency of approximately 1575 MHz. Stub 44 is a quarter wavelength stub which is open circuited and filters out signals at 1575 MHz. Stub 46, which is also open circuited, enhances the bandwidth of filter 14 around 1575 MHz.

Antenna 12 is designed to operate in the S-band frequency range of 2.2–2.3 GHz, but has the capability to operate at frequencies of 2.37 GHz. The polarization of antenna 12 has two modes resulting from the two feeds 16 and 18 to radiating element 10 of antenna 12.

The telemetry antenna of the present invention is identical to the telemetry antenna of U.S. Pat. No. 6,630,907, which issued Oct. 7, 2003 to Marvin L. Ryken and Albert F. Davis, co-inventors of the present invention.

Figure 3:
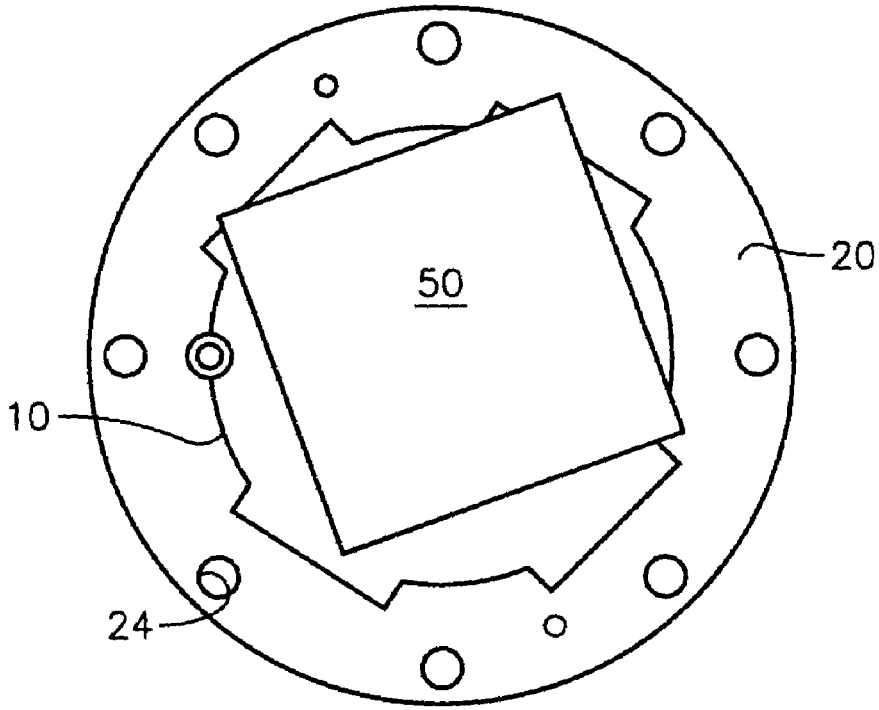
FIG. 3 is a view which illustrates placement of the GPS ceramic microstrip antenna on the circuit board of FIG. 1 for the TM microstrip antenna.

Referring to FIG. 3, FIG. 3 illustrates the placement of a GPS antenna 50 in the 1.364-inch diameter area of circuit board 20. A commercially available ceramic GPS square shaped microstrip antenna is used in the preferred embodiment of the invention. The GPS antenna 50 is a Toko DAX1575MS63T GPS microstrip antenna commercially available from Toko Incorporated of Tokyo, Japan 0.7 by 0.7 by 0.15 inch size). Ceramic GPS antenna 50 is manufactured from a very high dielectric constant. Although the GPS frequency of 1.575 GHz is lower than the telemetry frequency of 2.250 GHz, the antenna size of the ceramic GPS antenna 50 is smaller than the 1.364-inch diameter TM antenna 12. If the dielectric constants were the same for the GPS antenna and the TM antenna, the lower GPS frequency band would require that the GPS antenna have a larger size than the higher frequency TM antenna.

Figure 4:
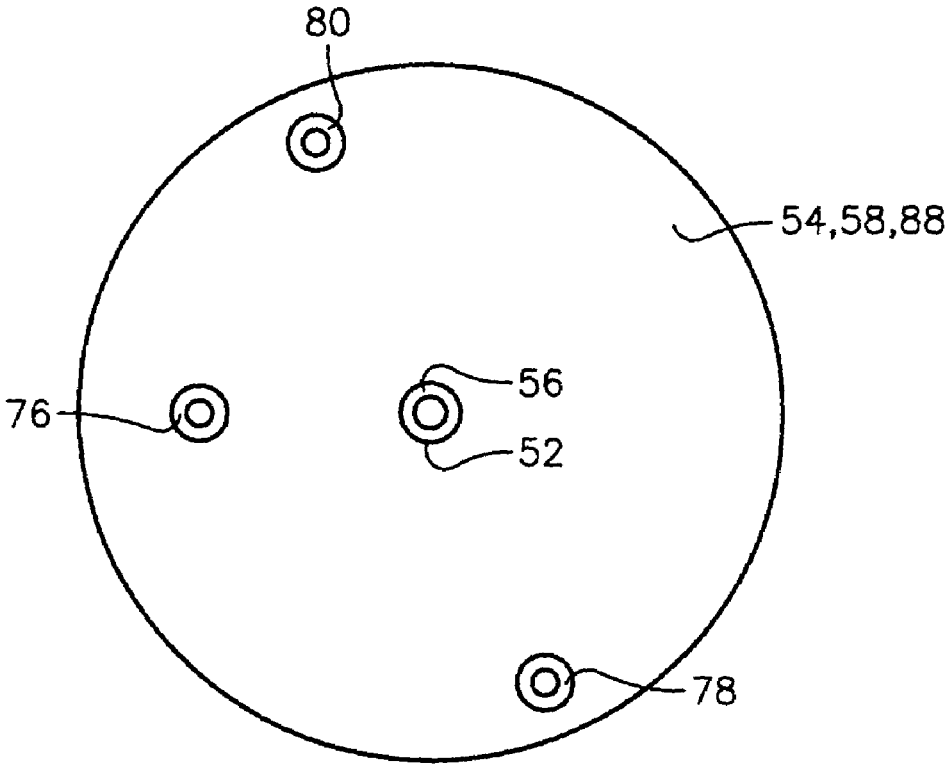
FIG. 4 illustrates the bottom layer of the ground PC board, and the bottom layer of the filter bottom PC board as well as the top layer of the filter top PC board for the TM microstrip antenna.
Figure 5:
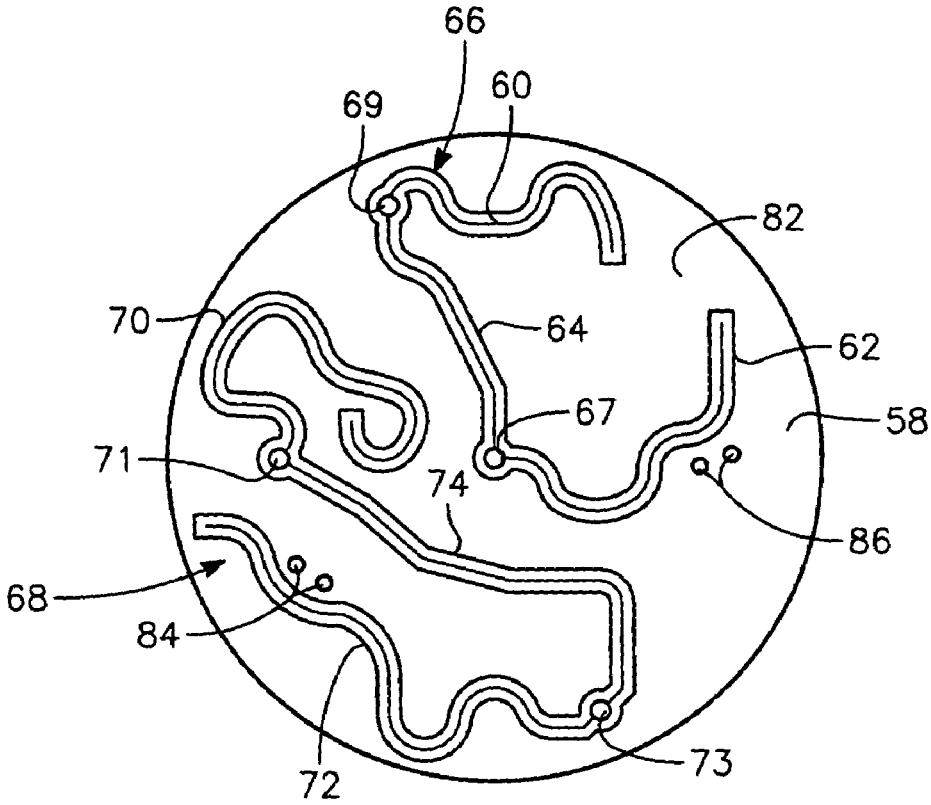
FIG. 5 illustrates a top view of the bottom layer of the filter top PC board of FIG. 4 for the TM microstrip antenna.

Referring to FIGS. 3, 4 and 5, approximate placement of the ceramic GPS antenna 50 on top of Circuit Board 20 is shown in FIG. 3. The ceramic GPS antenna 50 is epoxied to the top of the Circuit Board 20 and the output wire from the GPS antenna 50 passes through a 0.120-inch diameter plated through hole 52 centrally located in Circuit Board 20 and Ground Board 54. A Teflon insulator 56 obtained from a standard 0.141-inch diameter semi-rigid cable is inserted in the 0.12 diameter hole 52 of Circuit Board 20 and Ground Board 54. The feed wire from the GPS antenna 50 extends to the bottom layer of the Filter Top Printed Circuit Board 58 shown in FIG. 5.

Filter Top Printed Circuit Board 58 includes two-quarter wavelength open stubs 60 and 62 separated by a quarter wavelength copper transmission line 64 which form a band stop filter 66 at the TM frequency of approximately 2.25 GHz. The feed wire from the GPS antenna is connected to band stop filter 66 on the Filter Top Printed Circuit Board 58 shown in FIG. 5. The feed wire for GPS antenna 50 connects to filter 66 at electrical contact point 67 while the GPS output 80 (FIG. 4) connects to filter 66 at electrical contact point 69.

Filter Top Printed Circuit Board 58 of FIG. 5 also includes a band stop filter 68 at the GPS frequency of approximately 1575 MHz. The band stop filter 68 comprises two-quarter wavelength open stubs 70 and 72 separated by a quarter wavelength copper line 74. The band stop filter 68 is connected between the TM in signal line 76 (FIG. 4) from antenna 10 and the TM output 78 (FIG. 4). The TM in signal line 76 connects to filter 68 at electrical contact point 71 while the TM output 78 connects to filter 68 at the electrical contact point 73.

Referring to FIG. 5, the transmission lines forming filters 66 and 68 on Filter Top Printed Circuit Board 58 are surrounded by copper ground planes 82 that have vias 84 and 86 to the other side of Board 58 to make the isolation between the two filter circuits 66 and 68 as great as possible.

Figure 6:
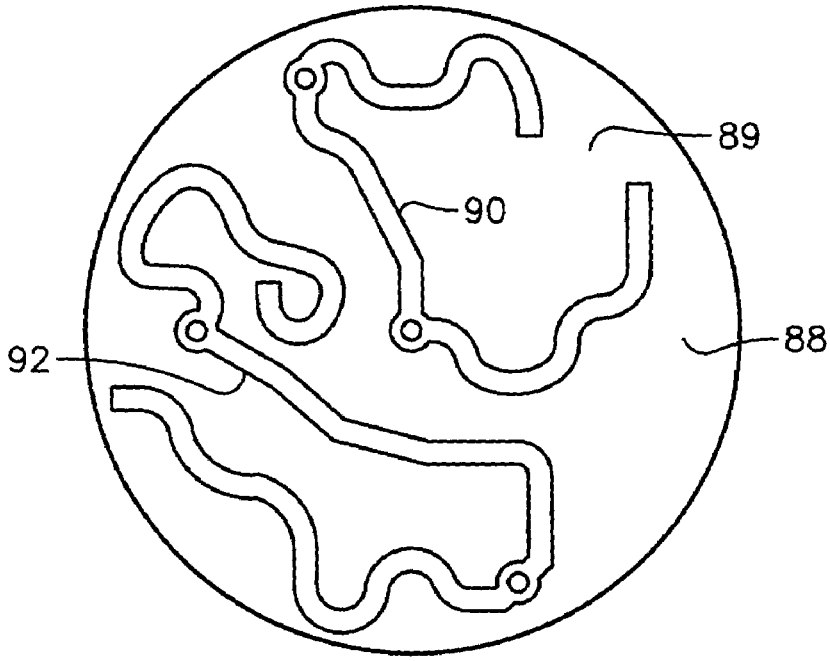
FIG. 6 illustrates the top layer of the filter bottom PC board of FIG. 4 for the TM microstrip antenna.

Referring to FIG. 4, the top layer of the Filter Top PCB 58, the bottom layer of the Filter Bottom PCB 88, and the bottom layer of the Ground PCB 54 are the same and shown in FIG. 4. These layers allow the antenna and filter to be tested separately and then joined and tested as a total antenna system. The top layer of the Filter Bottom PCB 88 is shown in FIG. 6 and is similar to the bottom layer of the Filter Top PCB (mirror image) except the copper transmission lines or traces have been removed. This exposes dielectric material 90 and 92 surrounded by plated copper 89.

The telemetry antenna 12 when assembled has four printed circuit boards stacked on top of one another. The Boards comprising antenna 12 are the Circuit Board 20, the Ground Board 54, the Filter Top Printed Circuit Board 58 and the Filter Bottom Printed Circuit Board 88. The Circuit PC and Ground PC Boards are fabricated from Rogers Corporation's Duriod 6010 with a 0.050-inch thickness clad with one-ounce copper. The Filter Top and Bottom PC Boards are fabricated from Rogers Corporation's Duriod 6002 with a 0.020-inch thickness clad with one-ounce copper. All the Boards of telemetry antenna 12 are gold plated so that resistance is minimized for maximum isolation and for environmental protection.

The assembly process for antenna 12 is as follows. The GPS antenna 50 is epoxied to the circuit board 20 in the manner illustrated in FIG. 3. The Filter Top Printed Circuit Board 58 and the Filter Bottom Printed Circuit Board 88 are assembled together and then tested. The quarter wavelength sections 44, 46, 60 and 62 were left a little bit long to allow for fine tuning and be within manufacturing tolerances. The minimum required isolation for antenna 12 is 40 dB in the TM and GPS frequency bands. Plot 110 in FIG. 9 illustrates isolation a function of frequency.

Figure 7:
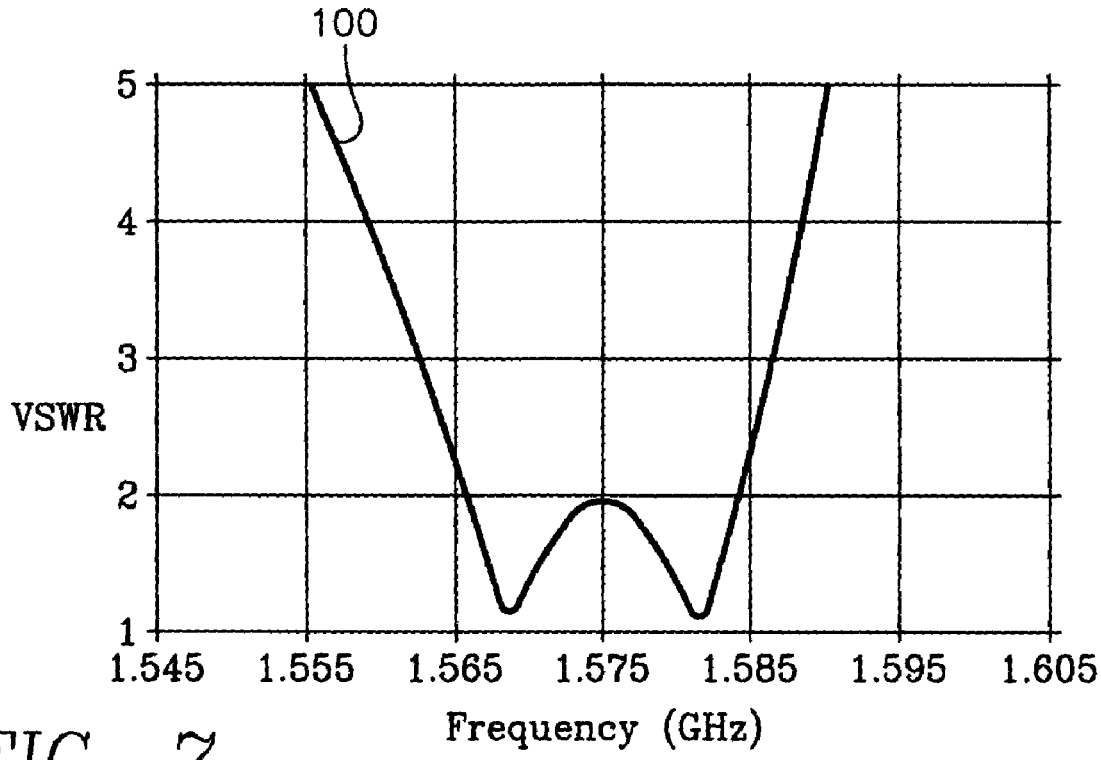
FIG. 7 illustrates a Voltage Standing Wave Ratio (VSWR) plot for the GPS microstrip antenna.
Figure 8:
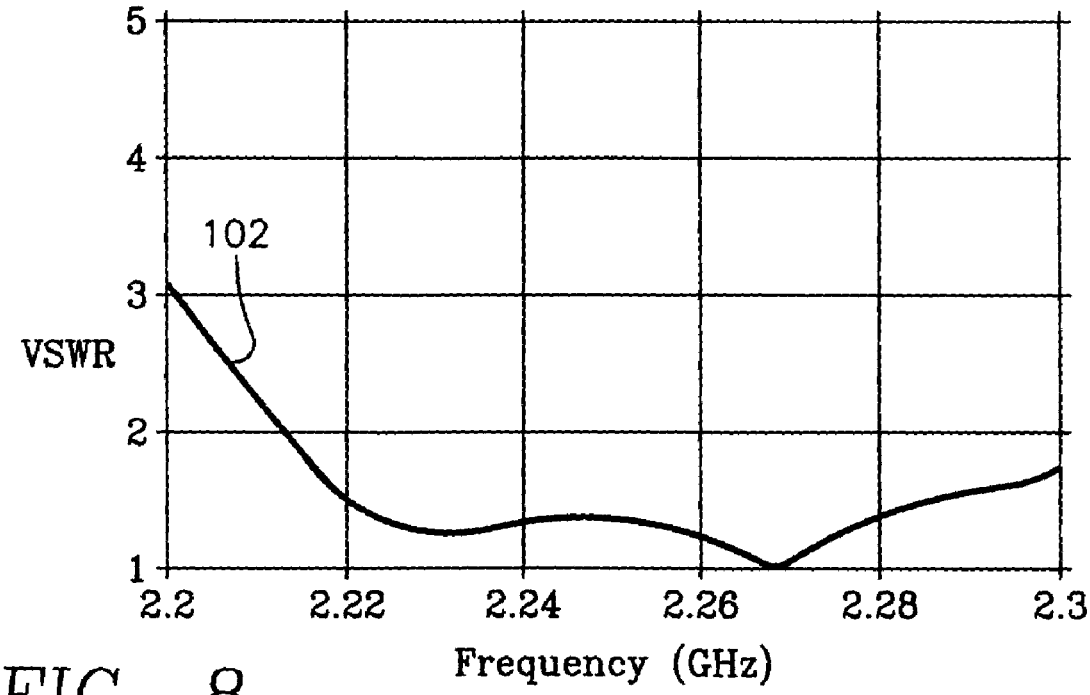
FIG. 8 illustrates a Voltage Standing Wave Ratio (VSWR) plot for the TM microstrip antenna.

Filters 66 and 68 are then connected to the Circuit and Ground Printed Circuit Boards 20 and 54, respectively, to form the final antenna. The TM antenna radiating element 10 and the GPS antenna 50 are each circular polarized and require tuning in both the horizontal and vertical polarization modes to achieve the required results. The GPS antenna 50 has a very narrow frequency bandwidth and the VSWR 100 (Voltage Standing Wave Ratio) over the L1 frequency band is illustrated in FIG. 7. The VSWR is less than 2:1 over 1575 MHZ±4 MHz. The TM antenna 12 has a substantially larger bandwidth and is tuned to obtain a center frequency of 2250 MHz with a 2:1 VSWR frequency bandwidth covering a substantial portion of the TM frequency band as shown in FIG. 8 by plot 102.

Figure 9:
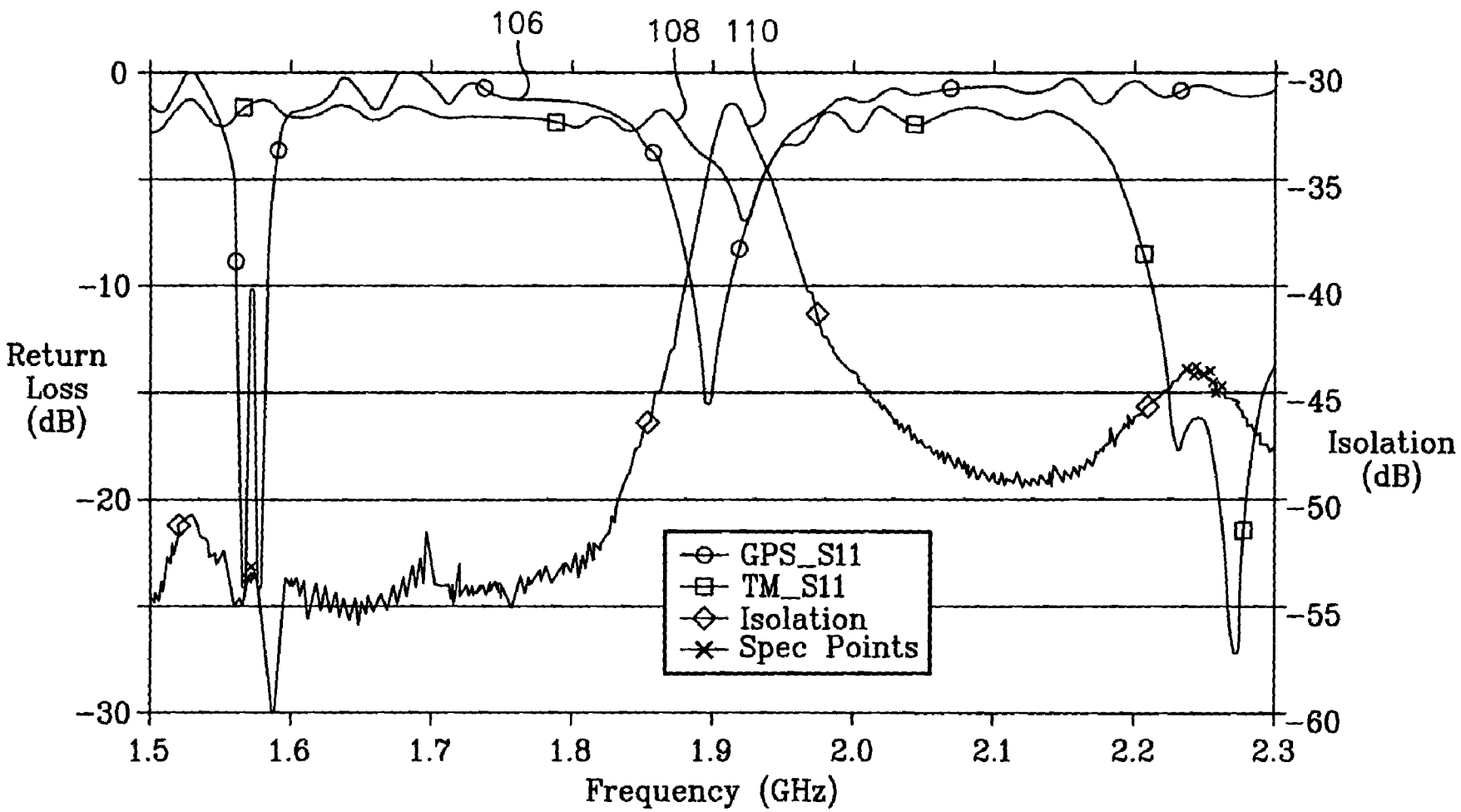
FIG. 9 illustrates TM to GPS isolation along with return loss plots after tuning the microstrip antenna.

Referring to FIG. 9, plot 110 depicts TM to GPS isolation over the frequency range of operation for both the TM and GPS antennas. Plot 108 illustrates the VSWR (Return Loss, dB) for the TM antenna over the frequency range of 1.5 to 2.3 GHZ. Plot 106 illustrates the VSWR for the GPS antenna over the frequency range of 1.5 to 2.3 GHZ.

From the foregoing, it is readily apparent that the present invention comprises a new, unique, and exceedingly useful TM microstrip antenna with GPS frequency coverage for use with a projectile or the like, which constitutes a considerable improvement over the known prior art. Many modifications and variations of the present invention are possible in light of the above teachings. It is to be understood that within the scope of the appended claims the invention may be practiced otherwise than as specifically described.

What is claimed is:

1. A microstrip antenna which provides for TM and GPS frequency coverage comprising:

(a) a ground plane printed circuit board having a bottom surface covered with copper plate, said ground plane printed circuit board having a circular shape;

(b) a circuit board positioned above said ground plane printed circuit board in alignment with said ground plane printed circuit board, said circuit board having an upper surface, a lower surface, and said circular shape;

(c) a telemetry microstrip antenna spaced apart from and electrically separated from said ground plane printed circuit board by said circuit board, said telemetry microstrip antenna being tuned over an S-Band frequency range of 2.2 to 2.3 GHz;

(d) said telemetry microstrip antenna including:

(i) a circular shaped radiating patch mounted on the upper surface of said circuit board for transmitting a first RF (radio frequency) signal having telemetry data contained therein; and (ii) a first filter mounted on the lower surface of said circuit board, said first filter being electrically connected to the radiating patch of said telemetry microstrip antenna to filter GPS (Global Positioning System) signals from the first RF signal transmitted by said radiating patch;

(e) a square shaped GPS microstrip antenna mounted above said telemetry microstrip antenna on said circuit board, said GPS microstrip antenna receiving a second RF signal having GPS data contained therein;

(f) a filter top printed circuit board positioned below said ground plane printed circuit board in alignment with said ground plane printed circuit board, said filter top printed circuit board having an upper surface, a lower surface, and said circular shape; and (g) said filter top printed circuit board including:

(i) a second filter mounted on the lower surface of said filter top printed circuit board, said second filter being electrically connected to the radiating patch of said telemetry microstrip antenna to filter said GPS signals from the first RF signal transmitted by the radiating patch of said telemetry microstrip antenna; and (j) a third filter mounted on the lower surface of said filter top printed circuit board in proximity to said second filter, said third filter being electrically connected to said GPS microstrip antenna to filter TM signals from said second RF signal received by said GPS microstrip antenna.

2. The microstrip antenna of claim 1 wherein said first filter, said second filter and said third filter each comprise a band stop filter.

3. The microstrip antenna of claim 1 wherein said second filter and said third filter provide for forty decibels of isolation between the S-Band Frequency range at which said telemetry microstrip antenna operates and an L1-Band Frequency range at which said GPS microstrip antenna operates.

4. The microstrip antenna of claim 1 further comprising a filter bottom printed circuit board positioned below the lower surface of said filter top printed circuit board in alignment with said filter top printed circuit board wherein said filter bottom printed circuit board has said circular shape.

5. The microstrip antenna of claim 4 wherein said circuit board, said ground plane printed circuit board, said filter top printed circuit board and said filter bottom printed circuit board each have a diameter of 1.364 inches and are aligned with one another to form said microstrip antenna which has said diameter of 1.364 inches.

6. The microstrip antenna of claim 4 wherein said filter top printed circuit board and said filter bottom printed circuit board are fabricated from a dielectric material which has 0.020 inch thickness.

7. The microstrip antenna of claim 1 wherein said circuit board and said ground plane printed circuit board are fabricated from a dielectric material which has 0.050 inch thickness and a dielectric constant of 10.2.

8. The microstrip antenna of claim 1 wherein said telemetry microstrip antenna has a Voltage Standing Wave Ratio of 2:1 over said S-Band frequency range of 2.2 to 2.3 GHz.

9. The microstrip antenna of claim 1 wherein said GPS microstrip antenna has a Voltage Standing Wave Ration of less than 2:1 over an L1-Band frequency range of 1575 MHZ±4.0 MHz.

10. A microstrip antenna which provides for TM and GPS frequency coverage comprising:

(a) a ground plane printed circuit board having a bottom surface covered with copper plate, said ground plane printed circuit board having a circular shape;

(b) a circuit board positioned above said ground plane printed circuit board in alignment with said ground plane printed circuit board, said circuit board having an upper surface, a lower surface, and said circular shape;

(c) a telemetry microstrip antenna spaced apart from and electrically separated from said ground plane printed circuit board by said circuit board, said telemetry microstrip antenna being tuned over an S-Band frequency range of 2.2 to 2.3 GHz;

(d) said telemetry microstrip antenna including:

(i) a circular shaped radiating patch mounted on the upper surface of said circuit board for transmitting a first RF (radio frequency) signal having telemetry data contained therein;

(ii) a first band stop filter mounted on the lower surface of said circuit board, said first band stop filter being electrically connected to the radiating patch of said telemetry microstrip antenna to filter GPS (Global Positioning System) signals from the first RF signal transmitted by said radiating patch; and (iii) first and second tuning tabs positioned diametrically opposite one another on the circumference of said radiating patch;

(iv) third and fourth tuning tabs positioned diametrically opposite one another on the circumference of said radiating patch; and (v) said first and second tuning tabs being positioned approximately perpendicular to said third and fourth tuning stubs on the circumference of said radiating patch wherein said first, second, third and fourth tuning tabs allow a user of said telemetry microstrip antenna to tune said telemetry microstrip antenna over said S-Band Frequency range of 2.2 to 2.3 GHz;

(e) a square shaped GPS microstrip antenna mounted above said telemetry microstrip antenna on said circuit board, said GPS microstrip antenna receiving a second RF signal at an L1 Frequency band having GPS data contained therein;

(f) a filter top printed circuit board positioned below said printed circuit board in alignment with said ground plane printed circuit board, said filter top printed circuit board having an upper surface, a lower surface, and said circular shape; and (g) said filter top printed circuit board including:

(i) a second band stop filter mounted on the lower surface of said filter top printed circuit board, said second band stop filter being electrically connected to the radiating patch of said telemetry microstrip antenna to filter said GPS signals from the first RF signal transmitted by the radiating patch of said telemetry microstrip antenna; and (ii) a third band stop filter mounted on the lower surface of said filter top printed circuit board in proximity to said second band stop filter, said third band stop filter being electrically connected to said GPS microstrip antenna to filter TM signals from said second RF signal received by said GPS microstrip antenna wherein said second band stop filter and said third band stop filter provide for forty decibels of isolation between the S-Band Frequency range at which said telemetry microstrip antenna operates and an L1-Band Frequency range at which said GPS microstrip antenna operates.

11. The microstrip antenna of claim 10 wherein said circuit board and said ground plane printed circuit board are fabricated from a dielectric material which has 0.050 inch thickness and a dielectric constant of 10.2.

12. The microstrip antenna of claim 10 wherein said filter top printed circuit board is fabricated from a dielectric material which has 0.020 inch thickness.

13. The microstrip antenna of claim 10 wherein said telemetry microstrip antenna has a Voltage Standing Wave Ratio of 2:1 over said S-Band frequency range of 2.2 to 2.3 GHz.

14. The microstrip antenna of claim 10 wherein said GPS microstrip antenna has a Voltage Standing Wave Ration of less than 2:1 over an L1-Band frequency range of 1575 MHZ±4.0 MHz.

15. A microstrip antenna which provides for TM and GPS frequency coverage comprising:

(a) a ground plane printed circuit board having a bottom surface covered with copper plate, said ground plane printed circuit board having a circular shape;

(b) a circuit board positioned above said ground plane printed circuit board in alignment with said ground plane printed circuit board, said circuit board having an upper surface, a lower surface, and said circular shape;

(c) a telemetry microstrip antenna spaced apart from and electrically separated from said ground plane printed circuit board by said circuit board, said telemetry microstrip antenna being tuned over an S-Band frequency range of 2.2 to 2.3 GHz;

(d) said telemetry microstrip antenna including:

(i) a circular shaped radiating patch mounted on the upper surface of said circuit board for transmitting a first RF (radio frequency) signal having telemetry data contained therein;

(ii) a first band stop filter mounted on the lower surface of said circuit board, said first band stop filter being electrically connected to the radiating patch of said telemetry microstrip antenna to filter GPS (Global Positioning System) signals from the first RF signal transmitted by said radiating patch; and (iii) first and second tuning tabs positioned diametrically opposite one another on the circumference of said radiating patch;

(iv) third and fourth tuning tabs positioned diametrically opposite one another on the circumference of said radiating patch; and (v) said first and second tuning tabs being positioned approximately perpendicular to said third and fourth tuning stubs on the circumference of said radiating patch wherein said first, second, third and fourth tuning tabs allow a user of said telemetry microstrip antenna to tune said telemetry microstrip antenna over said S-Band Frequency range of 2.2 to 2.3 GHz;

(e) a square shaped GPS microstrip antenna mounted above said telemetry microstrip antenna on said circuit board, said GPS microstrip antenna receiving a second RF signal at an L1 Frequency band having GPS data contained therein;

(f) a filter top printed circuit board positioned below said ground plane printed circuit board in alignment with said ground plane printed circuit board, said filter top printed circuit board having an upper surface, a lower surface, and said circular shape; and (g) said filter top printed circuit board including:

(i) a second band stop filter mounted on the lower surface of said filter top printed circuit board, said second band stop filter being electrically connected to the radiating patch of said telemetry microstrip antenna to filter said GPS signals from the first RF signal transmitted by the radiating patch of said telemetry microstrip antenna; and (ii) a third band stop filter mounted on the lower surface of said filter top printed circuit board in proximity to said second band stop filter, said third band stop filter being electrically connected to said GPS microstrip antenna to filter TM signals from said second RF signal received by said GPS microstrip antenna wherein said second band stop filter and said third band stop filter provide for forty decibels of isolation between the S-Band Frequency range at which said telemetry microstrip antenna operates and an L1-Band Frequency range at which said GPS microstrip antenna operates;

(h) a filter bottom printed circuit positioned below the lower surface of said filter top printed circuit board in alignment with said filter top printed circuit board wherein said filter bottom printed circuit board has said circular shape.

16. The microstrip antenna of claim 15 wherein said circuit board, said ground plane printed circuit board, said filter top printed circuit board and said filter bottom printed circuit board each have a diameter of 1.364 inches and are aligned with one another to form said microstrip antenna which has said diameter of 1.364 inches.

17. The microstrip antenna of claim 15 wherein said circuit board and said ground plane printed circuit board are fabricated from a dielectric material which has 0.050 inch thickness and a dielectric constant of 10.2.

18. The microstrip antenna of claim 15 wherein said filter top printed circuit board and said filter bottom printed circuit board are fabricated from a dielectric material which has 0.020 inch thickness.

19. The microstrip antenna of claim 15 wherein said telemetry microstrip antenna has a Voltage Standing Wave Ratio of 2:1 over said S-Band frequency range of 2.2 to 2.3 GHz and said GPS microstrip antenna has a Voltage standing Wave Ration of less than 2:1 over an L1-Band frequency range of 1575 MHZ±4.0 MHz.

20. The microstrip antenna of claim 15 wherein said second band stop filter and said third band stop filter each comprise a pair of quarter wavelength open copper stubs separated by a quarter wavelength copper transmission line wherein a first of said pair of quarter wavelength open copper stubs is connected to one end of said quarter wavelength copper transmission line, and a second of said pair of quarter wavelength open copper stubs is connected to the other end of said quarter wavelength copper transmission line.

* * * * *